US008887560B2

(12) United States Patent
Beer et al.

(10) Patent No.: US 8,887,560 B2
(45) Date of Patent: Nov. 18, 2014

(54) ELECTRIC ACTUATION OF A VALVE BASED ON KNOWLEDGE OF THE CLOSING TIME OF THE VALVE

(75) Inventors: Johannes Beer, Regensburg (DE); Erwin Achleitner, Obertraubling (DE)

(73) Assignee: Continental Automotive GmbH, Hannover (DE)

( * ) Notice: Subject to any disclaimer, the term of this patent is extended or adjusted under 35 U.S.C. 154(b) by 92 days.

(21) Appl. No.: 13/643,729

(22) PCT Filed: Apr. 13, 2011

(86) PCT No.: PCT/EP2011/055812

§ 371 (c)(1),
(2), (4) Date: Jan. 3, 2013

(87) PCT Pub. No.: WO2011/134794

PCT Pub. Date: Nov. 3, 2011

(65) Prior Publication Data

US 2013/0104636 A1 May 2, 2013

(30) Foreign Application Priority Data

Apr. 26, 2010 (DE) ..... 10 2010 018 290

(51) Int. Cl.
*F02M 65/00* (2006.01)
*F02D 41/20* (2006.01)
*F02D 41/24* (2006.01)

(52) U.S. Cl.
CPC ..... *F02M 65/001* (2013.01); *F02D 41/20* (2013.01); *F02D 41/2467* (2013.01); *F02D 41/247* (2013.01); *F02D 2041/2051* (2013.01); *F02D 2041/2055* (2013.01)
USPC ..... 73/114.49

(58) Field of Classification Search
USPC ..... 73/114.49
See application file for complete search history.

(56) References Cited

U.S. PATENT DOCUMENTS 4,653,447 A 3/1987 Linder et al. ..... 123/357
5,182,517 A 1/1993 Thelen et al. ..... 324/418

(Continued)

FOREIGN PATENT DOCUMENTS

DE 3817770 A1 11/1989 ..... F02D 41/20
DE 3843138 A1 6/1990 ..... B60T 8/36

(Continued)

OTHER PUBLICATIONS

German Office Action, Application No. 10 2010 018 290.7-26, 3 pages, Oct. 6, 2010.

(Continued)

*Primary Examiner* — Freddie Kirkland, III
(74) *Attorney, Agent, or Firm* — King & Spalding L.L.P.

(57) ABSTRACT

A method is provided for determining a time duration for an electric actuation of a valve which has a coil drive, in particular of a direct-injection valve for an internal combustion engine. The method may include a deactivation of a current flow through a coil of the coil drive, such that the coil is in a currentless state, a detection of a time profile of a voltage induced in the currentless coil, a determination of the closing time of the valve on the basis of the detected time profile, and a determination of a time duration of the electric actuation of the valve for a future injection process on the basis of the determined closing time. A corresponding device and a computer program for carrying out the described method are also disclosed.

12 Claims, 7 Drawing Sheets

(56) References Cited

U.S. PATENT DOCUMENTS

| | | | | |
|---|---|---|---|---|
| 5,245,501 | A | 9/1993 | Locher et al. | 361/154 |
| 5,861,746 | A | 1/1999 | Ensten | 324/207.16 |
| 5,880,920 | A | 3/1999 | Fischer et al. | 361/187 |
| 5,995,356 | A * | 11/1999 | Glavmo et al. | 361/154 |
| 6,949,923 | B2 | 9/2005 | Schultz et al. | 324/207.18 |
| 7,454,299 | B2 * | 11/2008 | Bolz | 702/64 |
| 8,019,569 | B2 | 9/2011 | Bolz | 702/150 |
| 8,128,004 | B2 | 3/2012 | Koch | 239/5 |
| 8,571,821 | B2 * | 10/2013 | Serra et al. | 702/64 |
| 2007/0090315 | A1 * | 4/2007 | Bolz | 251/129.04 |

FOREIGN PATENT DOCUMENTS

| | | | | |
|---|---|---|---|---|
| DE | 3942836 | A1 | 6/1991 | F02D 41/20 |
| DE | 4011217 | A1 | 10/1991 | B60T 8/36 |
| DE | 3426799 | C2 | 5/1993 | F02D 35/00 |
| DE | 19645062 | A1 | 6/1997 | B60T 8/36 |
| DE | 19611885 | A1 | 10/1997 | F02D 41/20 |
| DE | 10108425 | C1 | 6/2002 | A61M 16/20 |
| DE | 10150199 | A1 | 4/2003 | H01F 7/18 |
| DE | 10356858 | A1 | 7/2005 | F02D 41/20 |
| DE | 102005032087 | A1 | 1/2007 | F02D 41/20 |
| DE | 102006002893 | B3 | 7/2007 | F02D 41/20 |
| DE | 102008041528 | A1 | 3/2010 | F02D 41/22 |
| EP | 1777400 | A2 | 4/2007 | F02D 41/20 |
| WO | WO 2010023104 | A1 * | 3/2010 | |
| WO | 2011/134794 | A1 | 11/2011 | F02D 41/20 |

OTHER PUBLICATIONS

International Search Report and Written Opinion, Application No. PCT/EP2011/055812, 18 pages, Jul. 25, 2011.

* cited by examiner

ELECTRIC ACTUATION OF A VALVE BASED ON KNOWLEDGE OF THE CLOSING TIME OF THE VALVE

CROSS-REFERENCE TO RELATED APPLICATIONS

This application is a U.S. National Stage Application of International Application No. PCT/EP2011/055812 filed Apr. 13, 2011, which designates the United States of America, and claims priority to DE Application No. 10 2010 018 290.7 filed Apr. 26, 2010, the contents of which are hereby incorporated by reference in their entirety.

TECHNICAL FIELD

The present disclosure relates to the technical field of the actuation of coil drives for a valve, in particular for a direct injection valve for an internal combustion engine of an motor vehicle. The present disclosure relates, e.g., to a method for determining a duration for electric actuation of a valve comprising a coil drive. The present disclosure also relates to a corresponding device and to a computer program for carrying out the specified method.

BACKGROUND

In order to operate modern internal combustion engines and to comply with strict emission limiting values, an engine controller uses what is referred to as the cylinder charge model to calculate the air mass enclosed in a cylinder per working cycle. According to the modeled air mass and the desired ratio between the quantity of air and quantity of fuel (Lambda), the corresponding quantity of fuel setpoint value (MFF_SP) is injected by means of an injection valve which is also referred to as an injector in this document. In this way, the quantity of fuel which is to be injected can be dimensioned in such a way that a value for Lambda which is optimum for the exhaust gas post-treatment in the catalytic converter is present. For direct-injection spark emission engines with internal mixture formation, the fuel is injected into the combustion chamber with a pressure in the range from 40 to 200 bar.

The main request made to the injection valve is, as well as the tightness with respect to an uncontrolled output fuel and the preparation of the jet of the fuel to be injected, precise metering of a predefined setpoint injection quantity.

In particular, in the case of supercharged, direct-injection spark emission engines a very large quantity spread of the required quantity of fuel is necessary. It is therefore necessary for a maximum quantity of fuel MFF_max per working cycle to be metered, for example, for the supercharged operating mode at the full load of the engine, whereas in the operating mode close to idling a minimum quantity of fuel MFF_min has to be metered. The two characteristic variables MFF_max and MFF_min define here the limits of the linear working range of the injection valve. This means that for these injection quantities there is a linear relationship between the electric actuation duration (Ti) and the injected quantity of fuel per working cycle (MFF).

For direct injection valves with a coil drive, the quantity spread, which is defined at a constant fuel pressure as the quotient between the maximum quantity of fuel MFF_max and the minimum quantity of fuel MFF_min, is approximately 15. For future engines with the emphasis on carbon dioxide reduction, the cubic capacity of the engines is made smaller and the rated power of the engine is maintained or even raised by means of corresponding engine supercharging mechanisms. As a result, the requirement which is made of the maximum quantity of fuel MFF_max corresponds at least to the requirements of an induction engine with a relatively large cubic capacity. The minimum quantity of fuel MFF_min is, however, determined by means of the operating mode which is close to idling and the minimum air mass in the overrun mode of the engine with a reduced cubic capacity, and said minimum quantity of fuel MFF_min is therefore made smaller. In addition, direct injection permits distribution of the entire fuel mass along a plurality of pulses which permits, for example, compliance with more stringent emission limiting values in a catalytic converter heating mode by means of what is referred to as mixture stratification and a later ignition time. For future engines, for the above-mentioned reasons there will be increased demands made of both the quantity spread and the minimum quantity of fuel MFF_min.

In known injection systems, in the case of injection quantities which are smaller than MFF_min, a significant deviation of the injection quantity from the nominal injection quantity occurs.

This symmetrically occurring deviation is mainly due to fabrication tolerances at the injector as well as to tolerances of the output stage which actuates the injector in the engine controller, and therefore to deviations from the nominal actuation current profile.

The electric actuation of a direct injection valve typically occurs by means of a current-controlled full-bridge output stage. Under the peripheral conditions of a vehicle application it is only possible to achieve a limited accuracy of the current profile which is applied to the injector. The resulting variation in the actuation current as well as the tolerances at the injector have significant effects on the achievable accuracy of the injection quantity, in particular in the region of MFF_min and below.

The characteristic curve of an injection valve defines the relationship between the injected quantity of fuel MFF and the duration Ti of the electric actuation as well as of the fuel pressure FUP (MFF=f(Ti, FUP)). The inversion of this relationship Ti=g (MFF_SP, FUP) is used in the engine controller to convert the setpoint quantity of fuel (MFF_SP) into the necessary injection time. The influencing variables which are additionally included in this calculation, such as for example the internal pressure of the cylinder during the injection process, the temperature of the fuel and possible variations of the supply voltage, are omitted here for the sake of simplification.

FIG. 1*a* shows the characteristic curve of a direct injection valve. In this context, the injected quantity of fuel MFF is plotted as a function of the duration Ti of the electric actuation. As is apparent from FIG. 1*a*, a working range which is linear to a very good approximation is obtained for durations Ti longer than Ti_min. This means that the injected quantity of fuel MFF is directly proportional to the duration Ti of the electric actuation. For durations Ti shorter than Ti_min, a strongly nonlinear behavior is obtained. In the illustrated example, Ti_min is approximately 0.5 ms.

The gradient of the characteristic curve in the linear working range corresponds to the static flow through the injection valve, i.e. the fuel through-flow rate which is achieved continuously in the case of complete valve stroke. The cause of the nonlinear behavior for durations Ti is shorter than approximately 0.5 ms or for quantities of fuel MFF<MFF_min is, in particular, the inertia of an injector spring mass system and the chronological behavior during the buildup and reduction of the magnetic field by a coil, which magnetic field actuates the valve needle of the injection valve.

As a result of these dynamic effects, the complete valve stroke is no longer reached in what is referred to as the ballistic region. This means that the valve is closed again before the structurally predefined end position, which defines the maximum valve stroke, has been reached.

In order to ensure a defined and reproducible injection quantity, direct injection valves are usually operated in their linear working range. Currently, operation in the nonlinear range is not possible since owing to the above-mentioned tolerances in the current profile and mechanical tolerances of injection valves (for example prestressing force of the closing spring, stroke of the valve needle, internal friction in the armature/needle system), a significant systematic error occurs in the injection quantity. For a reliable operating mode of an injection valve, this results in a minimum quantity of fuel MFF_min per injection pulse, which minimum quantity of fuel MFF_min has to be at least provided in order to be able to implement the desired injection quantity accurately in terms of the quantity. In the example illustrated in FIG. 1*a*, this minimum quantity of fuel MFF_min is somewhat smaller than 5 mg.

FIG. 1*b* shows for the nonlinear operating range the respective deviation of the injection quantity relative to the nominal current profile (ΔI=0%) for relative errors in the current profile of varying severity.

The various relative errors in the current profile are −10%, −5%, −2.5%, +2.5%, +5% and +10% here. In the linear region which is not illustrated, and which starts at Ti=Ti_min=0.5 ms, an error in the current profile only has a weak effect on the accuracy of the quantity. However, starting from Ti<Ti_min and respectively MFF<MFF_min the quantity error increases significantly. Significant errors in the accuracy of the quantity occur in particular for injection times in the ballistic region.

The electric actuation of a direct injection valve which usually takes place by means of current-controlled full-bridge output stages of the engine controller. A full-bridge output stage makes it possible to supply the injection valve with a on-board power system voltage of the motor vehicle and alternatively with a boost voltage. The boost voltage (U_boost) can be, for example, approximately 60V. The boost voltage is usually made available by means of a DC/DC converter.

FIG. 2 shows a typical current actuation profile I (thick continuous line) for a direct injection valve with a coil drive. FIG. 2 also shows the corresponding voltage U (thin continuous line) which is applied to the direct injection valve. The actuation is divided into the following phases:

A) Pre-charge phase: during this phase of the duration t_pch, the bridge circuit of the output stage applies to the battery voltage U_bat, which corresponds to the on-board power system voltage of the motor vehicle, to the coil drive of the injection valve. When a current setpoint value I_pch is reached, the battery voltage U_bat is deactivated by a two-point controller and U_bat is switched on again after a further current threshold is undershot.

B) Boost phase: the pre-charge phase is adjoined by the boost phase. For this purpose, the output stage applies the boost voltage U_boost to the coil drive until a maximum current I_peak is reached. As a result of the rapid buildup of current, the injection valve opens in an accelerated fashion. After I_peak has been reached, a free-wheeling phase follows up until the expiry of t_1 and during said free-wheeling phase the battery voltage U_bat is in turn applied to the coil drive. The duration Ti of the electric actuation is measured from the start of the boost phase. This means that the transition into the free-wheeling phase is triggered by the predefined maximum current I_peak being reached. The duration t_1 of the boost phase is permanently predefined as a function of the fuel pressure.

C) Commutation phase: after the expiry of t_1, a commutation phase follows. Deactivation of the voltage results here in a self induction voltage which is limited substantially to the boost voltage U_boost. The voltage limitation during the self induction is composed of the sum of U_boost and of the forward voltages of a recovery diode and forward voltages of what is referred to as a free-wheeling diode. The sum of these voltages is referred to below as a recovery voltage. On the basis of a differential voltage measurement, on which FIG. 2 is based, the recovery voltage is formed in a negative fashion in the commutation phase.

As a result of the recovery voltage, a current flow is produced through the coil, which flow reduces the magnetic field. The commutation phase is timed and depends on the battery voltage U_bat and on the duration t_1 of the boost phase. The commutation phase ends after the expiry of a further duration t_2.

D) Holding phase: the commutation phase is adjoined by what is referred to as the holding phase. Here, the setpoint value for the holding current setpoint I_hold is controlled by means of the battery voltage U_bat, again by means of a two-point controller.

E) Deactivation phase: deactivation of the voltage results in a self induction voltage which, as explained above, is limited to the recovery voltage. This results in a current flow through the coil, which flow now decreases the magnetic field. After the recovery voltage which is formed here in a negative fashion has been exceeded, current does not flow anymore. This state is also referred to as "open coil". Owing to the ohmic resistances of the magnetic material, the eddy currents which are induced during the reduction of the field of the coil decay. The reduction in the eddy currents leads in turn to a change in the field in the magnetic coil and therefore to voltage induction. This induction effect leads to the voltage value at the injector rising from the level of the recovery voltage to the value "zero" according to the profile of an exponential function. After the reduction of the magnetic force, the injector closes by means of the spring force and the hydraulic force which is caused by the fuel pressure.

The described actuation of an injection valve has the disadvantage that the precise time of closing of the injection valve or of the injector cannot be determined in the "open coil" phase. Since a variation of the injection quantity correlates to the resulting variation in the closing time, the absence of this information results, in particular in the case of very small injection quantities which are smaller than MFF_min, in considerable uncertainty regarding the quantity of fuel which is actually introduced into the combustion chamber of a motor vehicle engine.

SUMMARY

In one embodiment, a method for determining a duration for electric actuation of a valve comprising a coil drive, in particular of a direct injection valve for an internal combustion engine, may comprise: deactivation of a current flow through a coil of the coil drive, with the result that the coil is currentless, detection of a time profile of a voltage induced in the currentless coil, determination of the closing time of the valve on the basis of the detected time profile, and determination of a duration of the electric actuation of the valve for a future injection process on the basis of the determined closing time.

In a further embodiment, the determination of the closing time comprises calculation of the time derivative of the detected time profile of the voltage induced in the currentless coil. In a further embodiment, the determination of the closing time comprises comparison of the detected time profile of the voltage induced in the coil with a reference voltage profile. In a further embodiment, the reference voltage profile is determined in that, during the securement of a magnet armature of the coil drive in the closed position of the valve, the voltage induced in the currentless coil is detected after the valve has been actuated electrically as in the real operation. In a further embodiment, the determination of the closing time comprises a comparison: (a) of a time derivative of the detected time profile of the voltage induced in the coil with (b) a time derivative of the reference voltage profile. In a further embodiment, the method also comprises actuation of the valve on the basis of the determined duration.

In a further embodiment, the determination of the duration is carried out by means of an iterative procedure for a sequence of different injection pulses, in which procedure a correction value is determined for the duration of the electric actuation of the valve for a future injection process as a function of: (a) a correction value for the duration of the electric actuation of the valve for a preceding injection process, and (b) a time difference between (b1) a nominal effective duration for the electric actuation of the valve, and (b2) an individual effective duration for the electric actuation of the valve for the preceding injection process, wherein the individual effective duration results from the time difference between the start of the electric actuation of the valve for the preceding injection process and the determined closing time for the preceding injection process. In a further embodiment, the time difference between the nominal effective duration and the individual effective duration is weighted with a weighting factor.

In another embodiment, a device is provided for determining a duration of electric actuation of a valve comprising a coil drive, in particular of a direct injection valve for an internal combustion engine, the device comprising: a deactivation unit for deactivating a current flow through a coil of the coil drive, with the result that the coil is currentless, a detection unit for detecting a time profile of a voltage induced in the currentless coil, and an evaluation unit configured to determine the closing time of the valve on the basis of the detected time profile and for determining a duration of the electric actuation of the valve for a future injection process on the basis of the determined closing time.

In another embodiment, a computer program is provided for determining a duration of electric actuation of a valve comprising a coil drive, in particular a direct injection valve, for an internal combustion engine, wherein, when the computer program is executed by a processor, said computer program is configured to provide any of the methods disclosed above.

BRIEF DESCRIPTION OF THE DRAWINGS

Example embodiments will be explained in more detail below with reference to figures, in which.

DETAILED DESCRIPTION

Figure 1A:
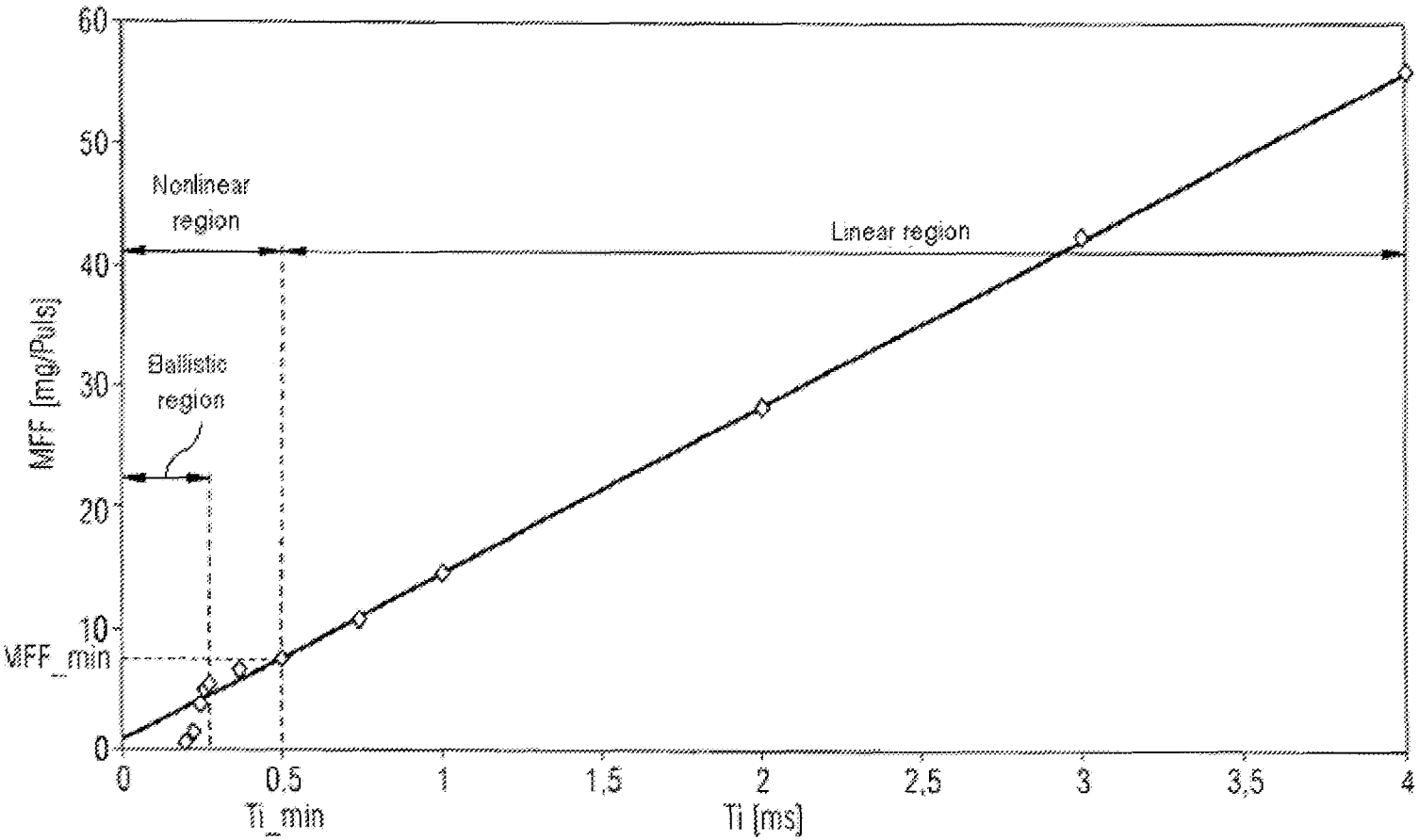
FIG 1a Prior art
FIG. 1*a* shows the characteristic curve of a known direct injection valve, illustrated in a diagram, in which the injected quantity of fuel MFF is plotted as a function of the duration Ti of the electric actuation.

Some embodiments improve the actuation of an injection valve to the effect that, a relatively high level of accuracy of quantities can be achieved, e.g., in the case of small injection quantities.

Some embodiments provide a method for determining a duration for electric actuation of a valve comprising a coil drive is described. The valve is, in particular, a direct injection valve for an internal combustion engine. The described method comprises (a) deactivation of a current flow through a coil of the coil drive, with the result that the coil is currentless, (b) detection of a time profile of a voltage induced in the currentless coil, (c) determination of the closing time of the valve on the basis of the detected time profile, and (d) determination of a duration of the electric actuation of the valve for a future injection process on the basis of the determined closing time.

Some embodiments are based on the recognition that by means of a suitable transformation of the electric actuation data including the previously determined closing time the actuation of the valve can be improved. As a result, in particular in the case of small injection quantities a relatively high level of accuracy degree of quantities can be achieved.

The determination of the closing time can be based, in particular, on the effect according to which, after the deactivation of the current flow or of the actuation current, the closing movement of a magnet armature and of a valve needle, connected thereto, of the coil drive leads to speed-dependent influencing of the voltage applied to the coil (injector voltage). In the case of a coil-driven valve, there is, of course, a reduction in the magnetic force after the deactivation of the actuation current.

As a result of a spring stress and a hydraulic force which is applied to the valve (caused for example by a fuel pressure), a resulting force is obtained which accelerates the magnet armature and the valve needle in the direction of the valve seat. Directly before the impacting on the valve seat, the magnet armature and valve needle reach their maximum speed. With this speed, the air gap between a core of the coil and the magnet armature then also increases. Owing to the movement of the magnet armature and the associated increase in the air gap, the remanent magnetism of the magnet armature leads to voltage induction in the coil. The maximum movement induction voltage which occurs then characterizes the maximum speed of the magnet armature and therefore the time of the mechanical closing of the valve.

The voltage profile of the voltage induced in the currentless coil is therefore determined at least partially by the movement of the magnet armature. Through a suitable evaluation of the time profile of the voltage induced in the coil, it is possible, at least in a good approximation, to determine the component which is under relative movement between the magnet armature and coil. In this way, information about the movement profile is also automatically acquired, which information permits accurate conclusions to be drawn about the time of the maximum speed and therefore also about the time of the closing of the valve.

The knowledge of the mechanical closing time permits the determination of what is referred to as an injector closing time Tclose, which is defined as the time difference between the deactivation of the actuation current or injector current and the detected closing of the valve or of the valve needle.

Some embodiments may provide the advantage that it can be carried out online in an engine control device. If, for example as a result of the above-mentioned tolerances of the injection valve and of the actuation electronics the valve closing behavior changes, in the described closing time detection method this change is therefore detected automatically and can be correspondingly compensated by changed actuation.

It is to be noted that in order to carry out the described method it is not necessary to determine the entire dynamic of the closing process of the valve. In order to optimize the actuation of the valve, merely the closing time can be determined. As a result, the requirements made of the computational power of an engine control device may be reduced.

It is also to be noted that the described duration differs from a known duration for the actuation of an injection valve over time by virtue of the fact that in the case of the described duration a previously acquired realization about the actual closing time of the valve is taken into account.

According to one exemplary embodiment, the determination of the closing time comprises calculation of the time derivative of the detected time profile of the voltage induced in the currentless coil. The closing time can be determined here by a local minimum in the time derivative of the induced voltage profile.

It is to be noted that the calculation can be restricted to a time interval in which the expected closing time lies. As a result, the computational complexity necessary for the described method can easily be reduced.

According to a further exemplary embodiment, the determination of the closing time comprises comparison of the detected time profile of the voltage induced in the coil with a reference voltage profile.

The reference voltage profile can be selected here such that it describes the component of the induced voltage which is caused by decaying eddy currents in the magnetic circuit of the coil drive. As a result, particularly accurate information about the actual movement of the magnetic armature can be acquired. The comparison may comprise, for example, simple difference formation between the voltage induced in the coil and the reference voltage profile.

The comparison can also be limited here to a time interval in which the expected closing time lies.

According to a further exemplary embodiment, the reference voltage profile is determined in that, during the securement of a magnet armature of the coil drive in the closed position of the valve, the voltage induced in the currentless coil is detected after the valve has been actuated electrically as in real operation.

Since a movement of the magnetic armature is prevented here, the reference voltage profile characterizes exclusively the voltage induced by decaying eddy currents in the magnet armature in the coil. In real operation, the difference between the time profile of the voltage induced in the currentless coil and the reference voltage which is determined in such a way therefore represents, in a very good approximation, the movement component of the induced voltage, which component is caused by the relative movement between the magnet armature and coil. As a result, the closing time can be determined with a particularly high level of accuracy.

The reference voltage profile can be described, for example, by parameters of a mathematical reference model. Thus, the described method can be carried out by a microcontroller which is programmed in a suitable way, with little or no hardware changes necessary for the electric actuation of a valve.

According to a further exemplary embodiment, the determination of the closing time comprises a comparison (a) of a time derivative of the detected time profile of the voltage induced in the coil with (b) a time derivative of the reference voltage profile. In this context, for example the difference between (a) the time derivative of the detected time profile of the voltage induced in the coil and (b) the time derivative of the reference voltage profile can be calculated.

The closing time can be determined by a local maximum or by a local minimum (depending on the sign of the difference formation). Here too, the evaluation, which comprises both the calculation of the two time derivatives and the difference formation, can be restricted to a time interval in which the expected closing time lies. The same can apply to a possibly present further closing time after a bouncing process.

The reference voltage profile can be modeled by an electronic circuit. Such an electronic circuit can comprise various components or modules such as, for example, a reference generator module, a subtraction module and an evaluation module.

The reference generator module may generate, for example, a reference signal which models, in synchronism with the current deactivation process of the coil, the coil voltage which is induced by the decaying eddy currents in the currentless coil and decays exponentially. The subtraction module serves for difference formation between the coil voltage and the reference signal in order to eliminate the voltage component of the coil signal which is induced by the decaying eddy currents. As a result, mainly the movement-induced component of the coil voltage remains. The evaluation module can detect the maximum of the movement-induced component of the coil voltage, which maximum induces the closing time of the injector.

According to a further exemplary embodiment, the method also comprises actuation of the valve on the basis of the determined duration.

The determined duration can be stored, like a conventional duration, for the actuation over time of an injection valve in an engine controller as a characteristic diagram. A characteristic diagram can be, in addition to the described duration for the electrical actuation, also further influencing variables such as, for example (a) a quantity setpoint value for the quantity of the fuel to be injected, (b) a fuel pressure which is applied to the valve on the input side, (c) a cylinder internal pressure during the injection and/or (d) the temperature of the fuel which is injected with the valve.

It is to be noted that the described method can be carried out in parallel for various injection valves of an engine. The different injection valves in this case can be assigned to one or more cylinders. In the case of the parallel actuation of a plurality of injection valves by means of an engine controller, the corresponding data can also be stored in a plurality of characteristic diagrams, in which a characteristic diagram is in each case assigned to an injection valve. As a result, individual actuation can take place for each injection valve.

According to a further exemplary embodiment, the determination of the duration is carried out by means of an iterative procedure for a sequence of different injection pulses. In this procedure, a correction value is determined for the duration of the electric actuation of the valve for a future injection process. This determination takes place as a function of (a) a correction value for the duration of the electric actuation of the valve for a preceding injection process, and (b) a time difference between (b1) a nominal effective duration for the electric actuation of the valve, and (b2) an individual effective duration for the electric actuation of the valve for the preceding injection process. The individual effective duration results here from the time difference between the start of the electric actuation of the valve for the preceding injection process and the determined closing time for the preceding injection process.

The term nominal effective duration is to be understood here as a duration which is characteristic of the type used by the injection valve. The nominal effective duration can therefore also be understood as the effective injection time of an injection valve of identical design, which injection time is obtained from the duration of the electric actuation of an injection valve of identical design and the closing time Tclose. In this context, the closing time Tclose is defined by the time difference between the deactivation of the actuation current and the determined closing of the valve or valve needle of the injection valve of identical design.

The nominal effective duration can be determined experimentally in advance by means of a typical injector output stage with nominal behavior and by means of an injection valve of identical design with nominal behavior. The individual effective duration can be determined, as described above, on the basis of the determined closing time for the electric actuation.

In graphic terms, in the described method the information uses "injection closing time" to detect the deviation of the actually injected quantity of fuel from the nominal quantity of fuel to be injected, which is defined by means of the setpoint value MFF_SP, and to adapt the electric actuation duration of the injection valve by means of a correction value in such a way that the deviation from the nominal quantity of fuel is minimized. This method can improve the accuracy of the injection quantity significantly, in particular for injection quantities which are smaller than the minimum quantity of fuel MFF_min.

According to a further exemplary embodiment, the time difference between the nominal effective duration and the individual effective duration is weighted with a weighting factor. This weighting factor can depend on the current operating conditions by means of a characteristic diagram. The dependence can be determined offline on the basis of experimental investigations.

Other embodiments provide a device for determining a duration of electric actuation of a valve comprising a coil drive, in particular a direct injection valve for an internal combustion engine. The described device comprises (a) a deactivation unit for deactivating a current flow through a coil of the coil drive, with the result that the coil is currentless, (b) a detection unit for detecting a time profile of a voltage induced in the currentless coil, and (c) an evaluation unit configured (c1) to determine the closing time of the valve on the basis of the detected time profile and (c2) for determining a duration of the electric actuation of the valve for a future injection process on the basis of the determined closing time.

Still other embodiments provide a computer program for determining a duration of electric actuation of a valve comprising a coil drive, in particular a direct injection valve, for an internal combustion engine, is described. When the computer program is executed by a processor, said computer program is configured to control the method mentioned above.

According to this disclosure, the specification of such a computer program is equivalent to the concept of a program element, a computer program product and/or a computer-readable medium which contains instructions on controlling a computer system in order to coordinate the method operation of a system or of a method in a suitable way, in order to achieve the effects which are associated with the disclosed method.

The computer program can be implemented as a computer-readable instruction code in any suitable programming language such as, for example, in JAVA, C++ etc. The computer program can be stored on a computer-readable storage medium (CD-Rom, DVD, Blu-ray Disc, removable drive, volatile or nonvolatile memory, installed memory/processor etc.). The instruction code can program a computer or other programmable devices such as, in particular, a control device for an engine of a motor vehicle in such a way that the desired functions are executed. In addition, the computer program can be made available in a network such as, for example, the Internet, from which it can be downloaded by a user when necessary.

Embodiments can be implemented either by means of a computer program, e.g., by means of software stored in a physical memory device or other non-transitory computer-readable media, as well as by means of one or more specific electric circuits, i.e., in the hardware or from any desired hybrid form, i.e., by means of software components and hardware components.

Figure 1B:
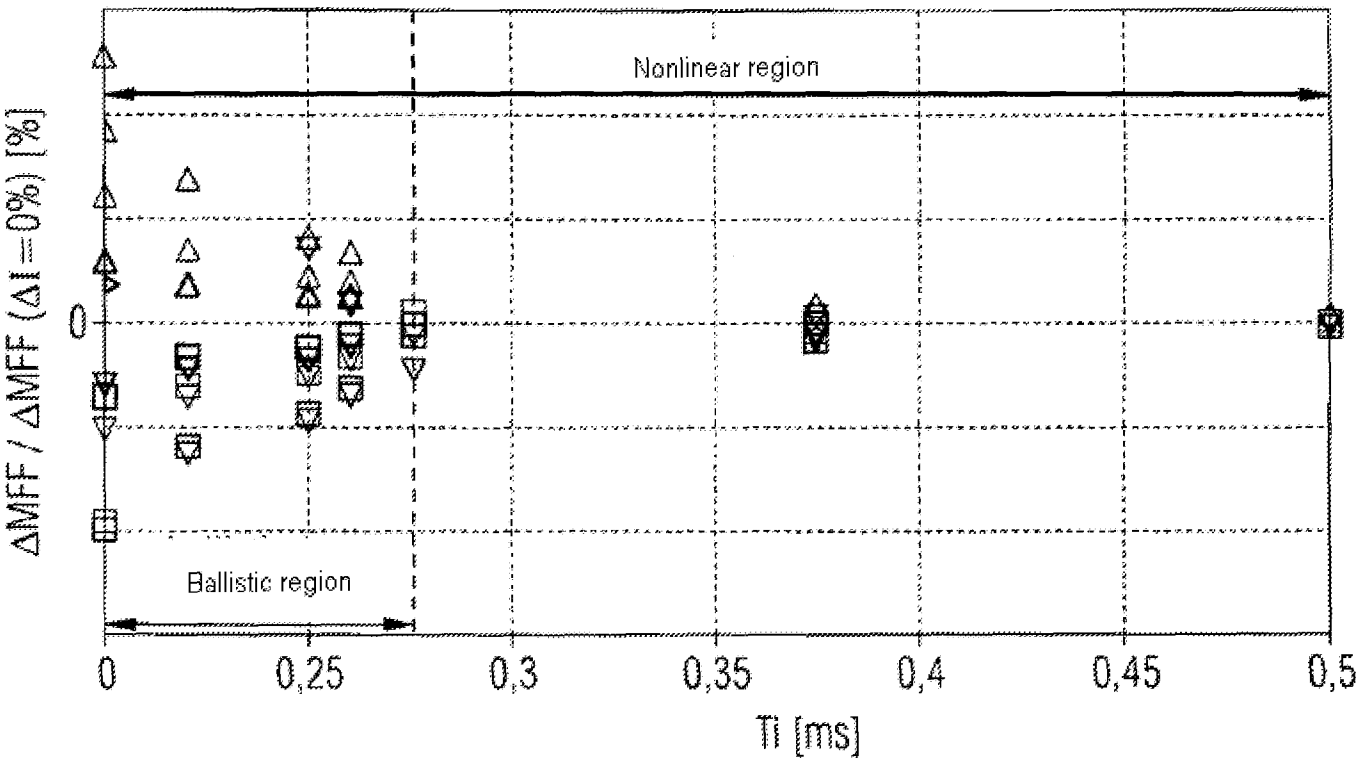
FIG 1b Prior art
FIG. 1*b* shows the respective deviation of the injection quantity relative to the nominal current profile for errors in the current profile of varying severity.
Figure 3A:
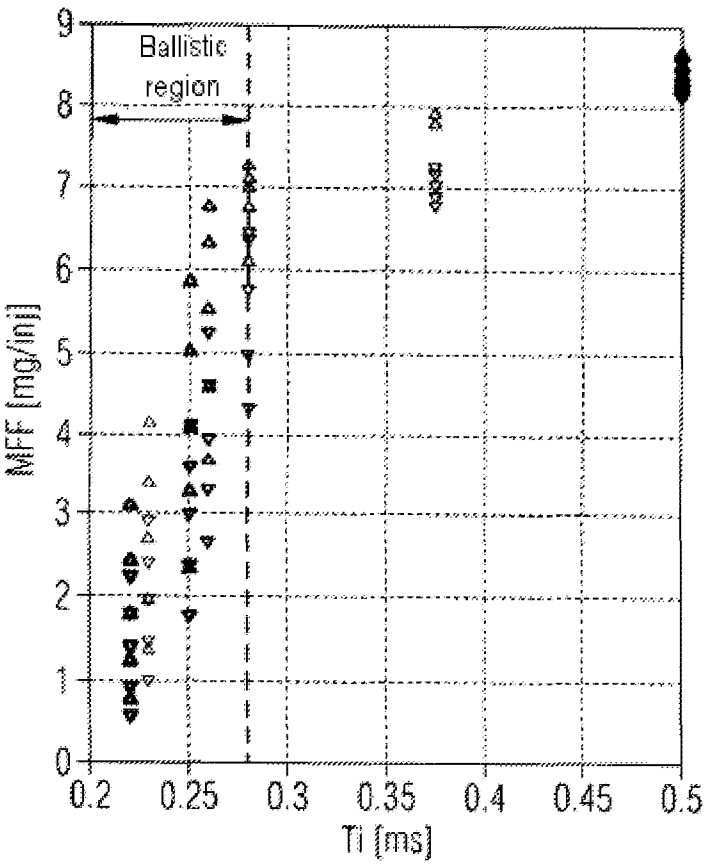
FIG 3a Prior art
FIG. 3*a* shows, in accordance with FIG. 1*b*, the effects of system tolerances on the injection accuracy as a function of the actuation duration Ti.

FIG. 3*a* shows, in accordance with FIG. 1*b*, the effects of system tolerances on the injection accuracy as a function of the actuation duration Ti. The effect of a variation of the current profile on the basis of the nominal actuation is illustrated in, in each case, two steps towards relatively high and relatively low current levels. This variation over, in each case, five different current levels was carried out for a first injector with a minimum tolerance situation and a second injector with a maximum tolerance situation. In total, this therefore results in 10 measuring points for each injection time. The measuring points for the first injector are illustrated with triangles pointing downwards. The measuring points for the second injector are illustrated with triangles pointing upwards. It is clearly apparent that a very large quantity spread results for actuation durations Ti in the ballistic region. The observed variation does not permit a stable and emission-optimized engine operating mode in the ballistic region.

Figure 3B:
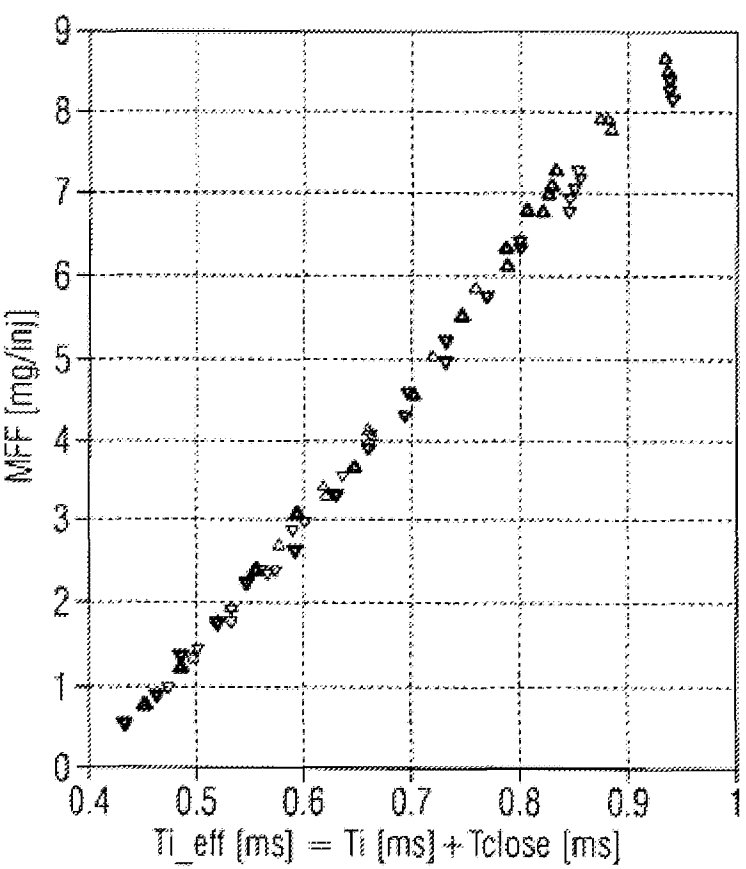
FIG. 3*b* shows the measurement result from FIG. 3*a*, wherein the abscissa is taken into account after a transformation of the actuation duration Ti toward an effective actuation duration in which the measured closing time of the injector is taken into account.

FIG. 3*b* shows the measurement result from FIG. 3*a*, wherein the abscissa is not modified according to a transformation of the actuation duration Ti towards an effective actuation duration in which the measured closing time of the injector is taken into account. The actually injected quantity of fuel per working cycle (MFF) is plotted on the ordinate, as in FIG. 3*a*. The transformation used is described by the following equation (1):

$$Ti_eff = Ti + Tclose \quad (1)$$

Ti_eff is here the effective actuation duration of the injection valve. Ti is the electric actuation duration used and Tclose is the determined closing time of the injector. As already described above, the closing time Tclose is defined as the time difference between the deactivation of the actuation current and the detected closing of the valve.

As is apparent from the transformed FIG. 3*b*, in the illustration MFF as a function of Ti_eff the quantity scatters which can be observed in FIG. 3*a* are eliminated in a very good approximation. This behavior is based on the realization that, in particular in the ballistic region, the systematic system tolerances observed (current accuracy of the injector output stage as well as mechanical tolerances of the injector) influence the closing of the injector and therefore the measured closing time Tclose. Since the closing time Tclose correlates to the quantity behavior, the effect of quantity spreads can be largely eliminated by including this information.

Figure 2:
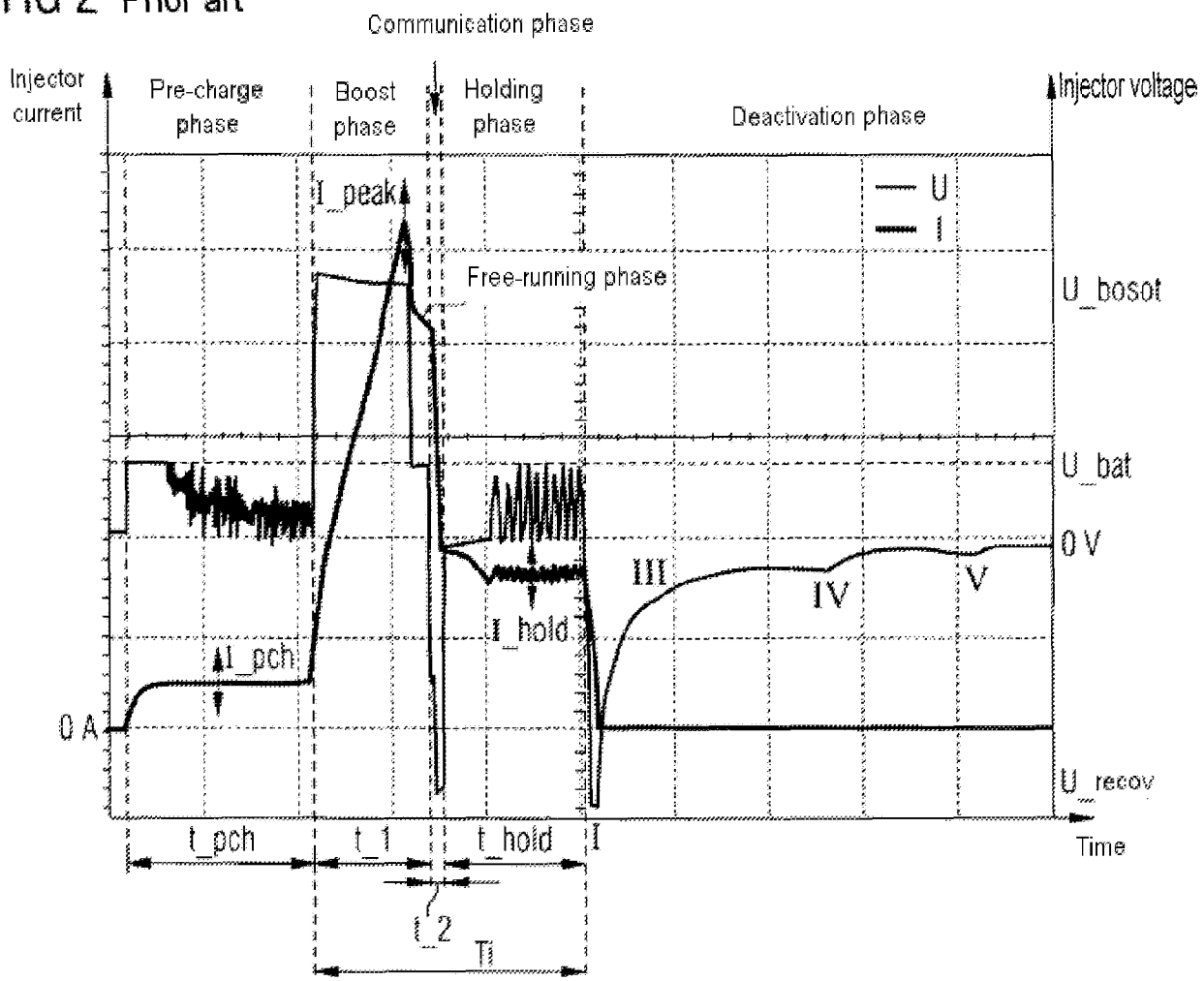
FIG 2 Prior art
FIG. 2 shows a typical current actuation profile and the corresponding voltage profile for a direct injection valve with a coil drive.

The closing time detection method which is described in this application and used for optimizing the valve actuation involves the following physical effects which occur in the deactivation phase of the injection valve:

1. Firstly, the deactivation of the voltage at the coil of the injection valve gives rise to a self induction voltage which is limited by the recovery voltage. The recovery voltage is typically, in terms of absolute value, somewhat larger than the boost voltage. As long as the self induction voltage exceeds the recovery voltage, a current flow occurs in the coil and the magnetic field in the coil is reduced. The chronological position of this effect is characterized by "I" in FIG. 2.

2. The magnetic force is already reduced during the decaying of the coil current. As soon as the spring prestress and the hydraulic force exceed the decreasing magnetic force owing to the pressure of the fuel which is to be injected, a resulting force occurs which accelerates the magnetic armature together with the valve needle in the direction of the valve seat.

3. If the self induction voltage no longer exceeds the recovery voltage, current no longer flows through the coil. The coil is electrically in what is referred to as the "open coil" operating mode. Owing to the ohmic resistances of the magnetic material of the magnet armature, the eddy currents which are induced during the reduction of the field of the coil decay exponentially. The reduction in the eddy currents leads in turn to a change in the field in the coil and therefore to the induction of a voltage. This induction effect leads to a situation in which the voltage value at the coil rises from the level of the recovery voltage to the value "zero" in accordance with the profile of an exponential function. The time position of this effect is characterized by "III" in FIG. 2.

4. Directly before the impacting of the valve needle in the valve seat, the magnet armature and valve needle reach their maximum speed. At this speed, the air gap between the coil core and the magnet armature increases. Owing to the movement of the magnet armature and the associated increase in the air gap, the remanent magnetism of the magnet armature gives rise to a voltage induction in the coil. The maximum induction voltage which occurs characterizes the maximum speed of the magnet armature (and also of the associated valve needle) and therefore the time of mechanical closure of the valve needle. This induction effect which is caused by the magnet armature and the associated valve needle speed is superimposed on the induction effect owing to the decay of the eddy currents. The time position of this effect is characterized in FIG. 2 by "IV".

5. After the mechanical closure of the valve needle, a bouncing process often occurs in which the valve needle briefly deflects once more from the closed position. Owing to the spring stress and the fuel pressure which is applied, the valve needle is, however, pressed back into the valve seat. The closure of the valve after the bouncing process is characterized by "V" in FIG. 2.

The method which is described in this application is then based on detecting the closing time of the injection valve from the induced voltage profile in the deactivation phase. As is explained below in detail, this detection can be carried out with different methods.

Figure 4A:
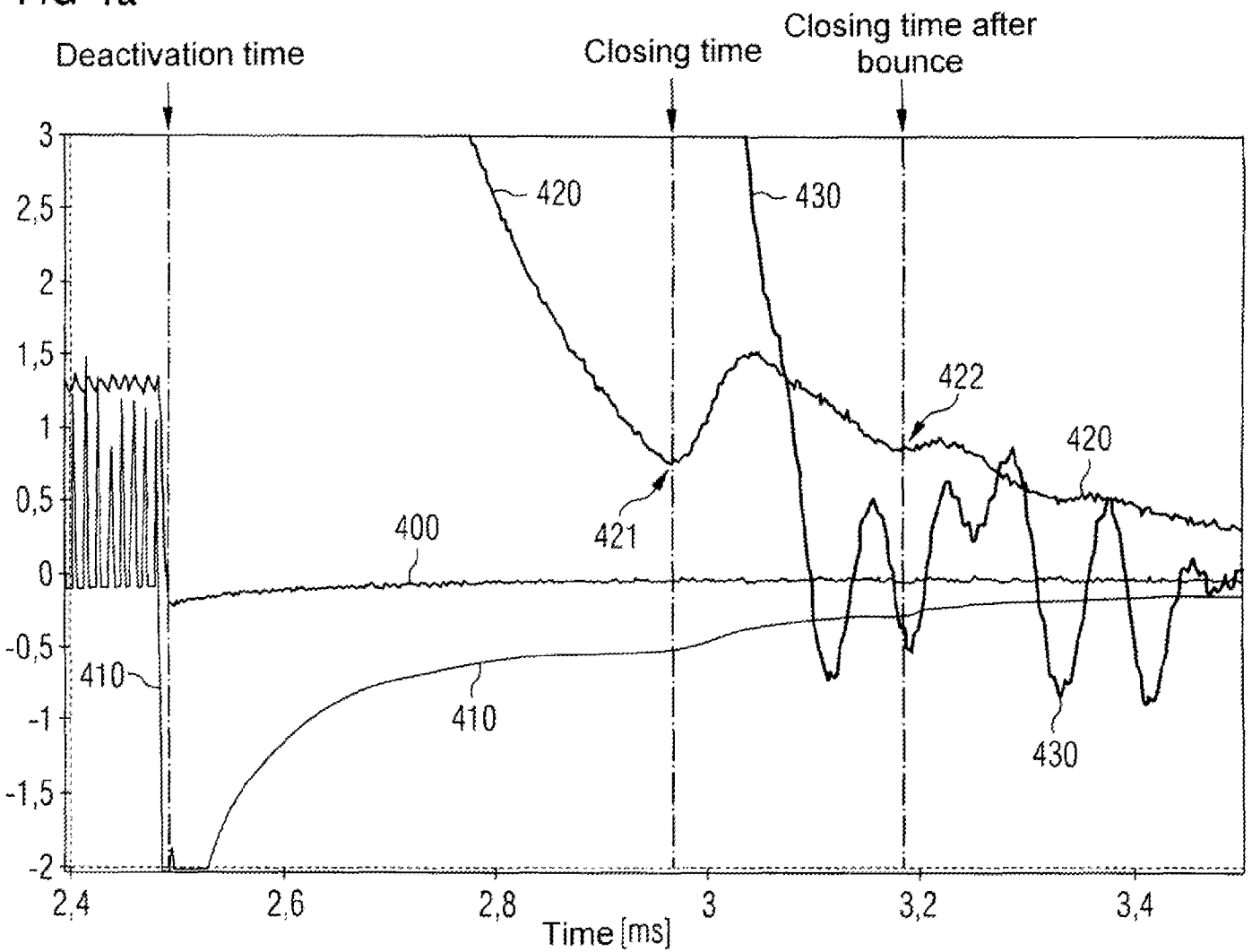
FIG. 4*a* shows detection of the closing time on the basis of a time derivative of the voltage profile induced in the coil.

FIG. 4*a* shows various signal profiles at the end of the holding phase and in the deactivation phase. The transition between the holding phase and the deactivation phase occurs at the deactivation time which is illustrated by a vertical dashed line. The current through the coil is illustrated by the curve in the ampere unit, provided by the reference symbol 400. In the deactivation phase, an induced voltage signal 410 results from superimposition of the induction effect owing to the speed of the magnet armature and of the valve needle and the induction effect owing to the decay of the eddy currents. The voltage signal 410 is illustrated in units of 10 volts. It is apparent from the voltage signal 410 that the speed of the increase in voltage decreases greatly in the region of the closing time before the speed of the increase in voltage increases again owing to the bouncing of the valve needle and magnet armature. The curve which is provided with the reference sign 420 represents the time derivative of the voltage signal 410. In this derivative 420, the closing time can be seen at a local minimum 421. After the bouncing process, a further closing time can be seen at a further minimum 422.

FIG. 4*a* also shows a curve 430 which illustrates the through-flow of fuel in the unit of grams per second. It is apparent that the measured through-flow of fuel through the injection valve drops very quickly from above shortly after the detected closing time. The chronological offset between the closing time, detected on the basis of the evaluation of the actuation voltage, and the time at which the measured through-flow rate of fuel reaches the value zero for the first time results from limited measurement dynamic during the determination of the through-flow of fuel. Starting from a time of approximately 3.1 ms, the corresponding measurement signal 430 settles at the value "zero".

In order to reduce the computational power necessary to carry out the described closing time detection method, the determination of the derivative 420 can also merely be carried out within a limited time interval which contains the expected closing time.

If, for example, a time interval I with the width 2Δt about the expected closing time $t_{Close_Expected}$ is defined, the following applies to the actual closing time $t_{Close}$:

$$I=[t_{Close_Expected}-\Delta t, t_{Close_Expected}+\Delta t]$$

$$U_{min}=\min\{dU(t)/dt|t \in I\}$$

$$t_{close}=\{t \in I(t)=U_{min}\} \quad (2)$$

As already indicated above, this approach can be extended in order to detect the renewed closure of the valve on the basis of a bouncing valve needle at a time $t_{Close_Bounce}$. In this respect, a time interval with the width $2\Delta t_{Bounce}$ about the time $t_{Close_Bounce_Expected}$ of the expected closure after the first bouncing process is defined. The time $t_{Close_Bounce_Expected}$ is defined relative to the closing time $t_{close}$ by means of $t_{Close_Bounce_Expected}$.

$$I_{Bounce}=[t_{close}+t_{Close_Bounce_Expected}-\Delta t\text{Bounce}, t_{close}+t_{Close_Bounce_Expected}+\Delta t_{Bounce}]$$

$$U_{min_Bounce}=\min\{dU(t)/dt|t \in I_{Bounce}\}$$

$$t_{close_Bounce}=\{t \in I_{Bounce}|U(t)=U_{min_Bounce}\} \quad (3)$$

Figure 4B:
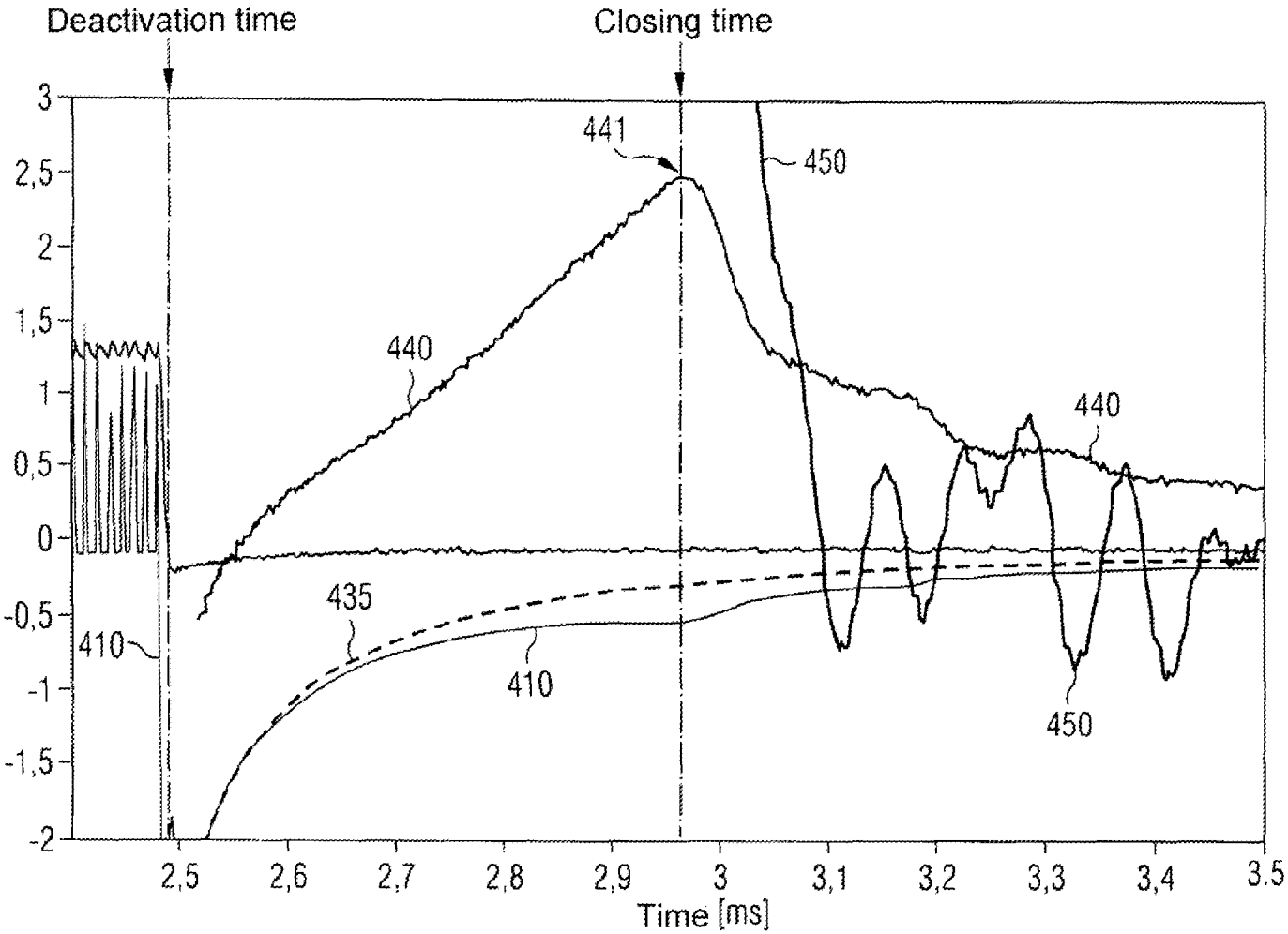
FIG. 4*b* shows detection of the closing time using a reference voltage profile which characterizes the induction effect in the coil on the basis of the decay of eddy currents in the magnet armature.

FIG. 4*b* shows a detection of the closing time using a reference voltage profile which characterizes the induction effect in the coil on the basis of the decaying of eddy currents in the magnet armature. FIG. 4*b* illustrates, like FIG. 4*a*, the end of the holding phase and the deactivation phase. The measured voltage profile 410, which is produced from superimposition of the induction effect owing to the speed of the air gap and the identical speed of the valve needle and the induction effect owing to the decaying of the eddy currents is the same as in FIG. 4*a*. The coil current 400 is also unchanged compared to FIG. 4*a*.

The idea is now to calculate the component of the voltage signal 410 which is caused exclusively by the induction effect owing to the decaying of the eddy currents, by means of a reference model. A corresponding reference voltage signal is illustrated by the curve with the reference symbols 435. By determining the voltage difference between the measured voltage profile 410 and the reference voltage signal 435 it is possible to eliminate the induction effect owing to decaying eddy currents. The difference voltage signal 440 therefore characterizes the movement-related induction effect and is a direct measure of the speed of the magnet armature and the valve needle. The maximum 441 of the difference voltage signal 440 characterizes the maximum speed of the magnet armature and speed of the valve needle which is reached directly before the impacting of the needle on the valve seat. As a result, the maximum 441 of the difference voltage signal can be used to determine the actual closing time.

A simple phenomenological reference model is given below as an example. The reference model can be calculated online in the electronic engine controller. However, other physical model approaches are also conceivable.

The reference model is started (t=0) as soon as or after the self induction voltage no longer exceeds the recovery voltage but before the $t_{Close_Expected}$ is reached, and therefore current no longer flows through the coil. The coil is then electrically in the "open coil" operating mode. The reference voltage profile 435 is measured for a reference injector on the injection test bench in the case of a fuel pressure which is higher than the maximum opening pressure. The injector is clamped hydraulically in a closed position here despite electric actuation. The voltage profile which is measured here (not illustrated but identical to 435 with the exception of inaccuracies of the model) in the deactivation phase therefore exclusively characterizes the voltage component which is induced by eddy currents which decay exponentially.

The model parameter or parameters of the reference model can be subsequently optimized in the offline operating mode in such a way that the best possible correspondence to the measured voltage profile 435 is achieved. This can be achieved in a known fashion by minimizing a quality measure by means of a gradient searching method.

Generally, for the modelled reference voltage $U_{INJ_MDL}$ a time-dependent model with the parameters of a measured voltage start value $U_{start}$ is obtained from the deactivation phase, the electric resistance and the temperature behavior of the magnetic material $R_{MAG_Material}$ (e) in which the eddy currents flow and the current value $I_{hold}$ in the holding phase at the time of deactivation. This can be described mathematically by the following equation:

$$U_{INJ_MDL}(t)=f(U_{Start},R_{MAG_Material}(\theta),J_{hold}) \quad (4)$$

A simple implementation can be achieved by means of the following model. The time constant with the dependencies of the injector temperature θ and $I_{hold}$ is stored according to the exemplary embodiment illustrated here by means of a characteristic diagram.

$$U_{INJ_MDL}(t)=U_{start}\cdot[1-\exp\{t/\pi(\theta,J_{hold})\}] \quad (5)$$

The closing time is obtained, as above, from the determination of the local maximum of the voltage difference 440 between the reference model 435 and the measured induction voltage 410. This evaluation can take place in turn in the time interval I with the width $2\Delta t_{Bounce}$ about the expected closing time $t_{Close_Expected}$.

$$I[t_{Close_Expected}-\Delta t,t_{Close_Expected}+\Delta t]$$

$$U_{diff_max}=\max\{U_{INJ_MDL}(t)-U_{INJ_MES}(t)|t\in I\}$$

$$t_{close}=\{t\in I|[U_{INJ_MDL}(t)-U_{INJ_MES}(t)]=U_{diff_max}\} \quad (6)$$

Here, $U_{INJ_MES}(t)$ stands for the measured voltage signal 410.

As already shown above, the algorithm can be widened by defining a suitable observation time interval in order to detect the renewed closure of the injector at the time $t_{Close_Bounce}$ owing to a bouncing injector needle.

In the text which follows, an optimized setpoint value determination for the electric actuation of an injection valve is carried out in order to improve the accuracy of the quantities.

In conventional systems, the electric actuation duration Ti in an engine controller is stored as a characteristic diagram, or in the case of a plurality of injection valves is stored as a set of different characteristic diagrams. In addition to what is referred to as setpoint value MFF_SP of the quantity of fuel and the fuel pressure FUP, the cylinder internal pressure $P_{Cyl}$ applied during the injection and the fuel temperature $\theta_{Fuel}$ are taken into account as additional influencing variables. This is described in equation (7):

$$Ti=f_1(MFF_SP,FUP,P_{Cyl},\theta_{Fuel}) \quad (7)$$

As a preparation for the method described in this application, a characteristic diagram for the setpoint value Ti_eff_sp will now also be additionally introduced for the effective actuation duration or actual injection duration defined in equation (1). This relationship is determined experimentally in advance by means of an injector output stage and an injector with a nominal behavior. In this context, by means of FIG. 3*b* the value Ti_eff_sp is determined as a function of the setpoint value MFF_SP which defines the quantity of fuel which is to be nominally injected. The setpoint value Ti_eff_sp is obtained with the following equation (8):

$$Ti_eff_sp=f_2(MFF_SP,FUP,P_{cyl},\theta_{Fuel}) \quad (8)$$

In the text which follows, the use of the guide variable Ti_eff_sp which is defined on the basis of equation (8) is described for a controlled operating mode of an injection valve for improving the accuracy of the quantities:

At first, by using equation (8) the real quantity behavior MFF is determined by the measured effective injection duration Ti_eff. A deviation from the nominal quantity of fuel MFF_SP is detected by means of a deviation of Ti_eff from the nominal value Ti_eff_sp.

Figure 5:
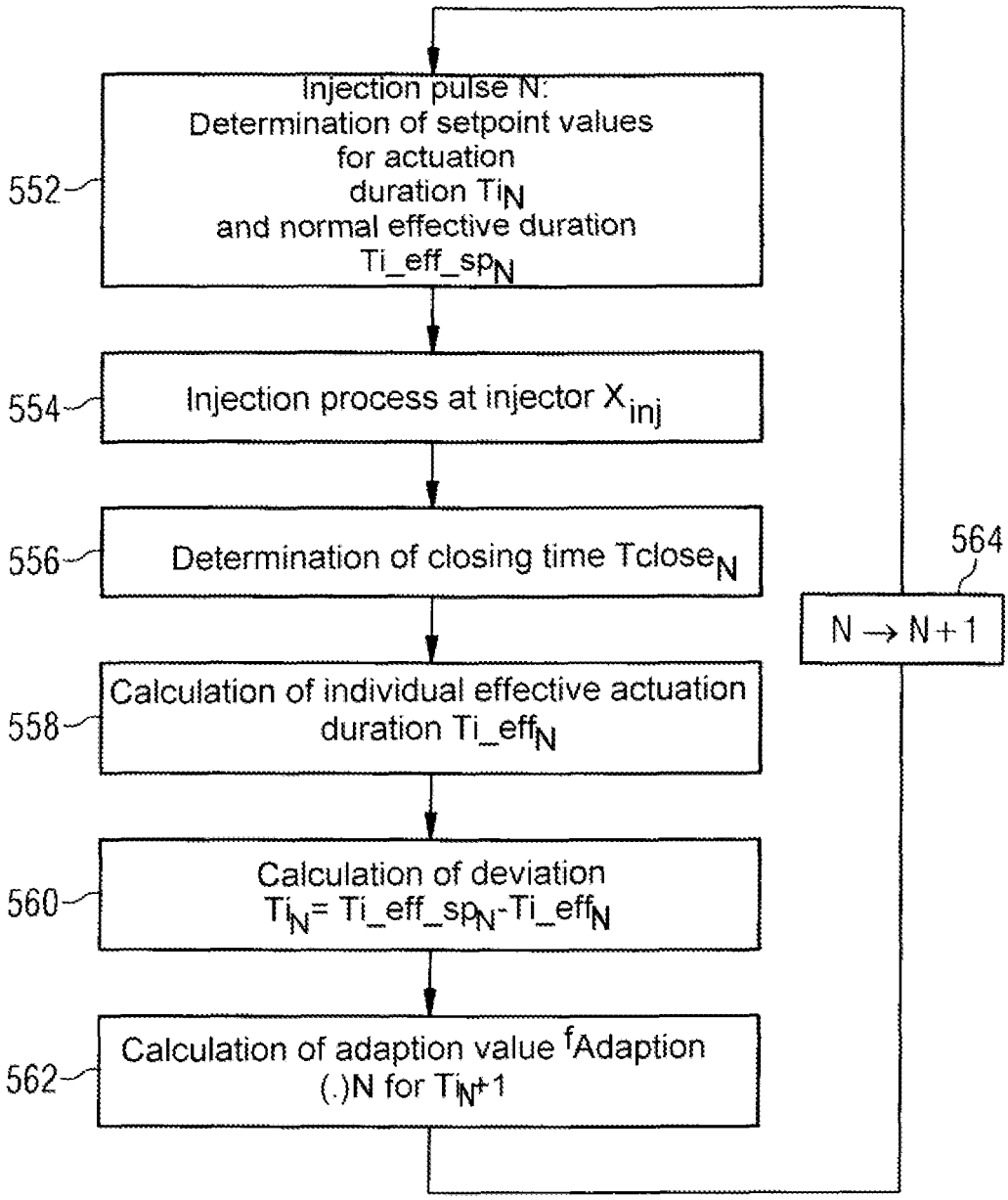
FIG. 5 shows a flowchart of a method for electrically actuating a valve on the basis of knowledge of the closing time of the valve.

FIG. 5 shows an algorithm for a controlled operating mode of an injection valve. The algorithm can be carried out individually for any injector $X_{Inj}$. The flowchart which describes the algorithm starts with a step 552 at the N-th injection pulse. The value N is used below as a subscript index.

Step 552:

In the step 552, setpoint values are determined for (A) the actuation duration $Ti_N$ and (B) the nominal effective duration $Ti_eff_sp_N$.

(A) The actuation duration $Ti_N$ for the N-th injection pulse results here from the following equation (9):

$$Ti_N=f_1(\bullet)+f_{Adaptation}(\bullet)_{N-1} \quad (9)$$

The following applies here:

$f_1(\bullet)=f_1$ (MFF_SP, FUP, $P_{Cyl}$, $\theta_{Fuel}$) (cf. equation (7) above) and $f_{Adaptation}(\bullet)_{N-1}=f_{Adaptation}$ (MFF_SP, FUP, $P_{Cyl}$, $\theta_{Fuel}$, $X_{Inj})_{N-1}$ The adaptation characteristic diagram $f_{Adaptation}$ is adapted online in the engine controller according to the exemplary embodiment illustrated here. In the case of a new injection system (N=1), in which values are not yet stored in the non-volatile memory of the engine controller, the injection time is not corrected since corrections have not yet been learnt. This means that $f_{Adaptation}$ has the value zero.

(B) The setpoint value for the nominal effective duration $Ti_eff_sp_N$ for the N-th injection pulse is obtained from the equation (8) above:

$$Ti_eff_sp_N=f_2(MFF_SP,FUP,P_{Cyl},\theta_{Fuel})_N \quad (10)$$

Step 554:

In the step 554, on the basis of the determined values for $Ti_N$ and $Ti_eff_sp_N$ the N-th injection process is executed at the injector $X_{Inj}$.

Step 556:

In the step 556, the closing time $Tclose_N$ is determined or measured with the method described in detail above.

Step 558:

In the step 558, the individual effective actuation duration $Ti_eff_N$ for the N-th injection process which is carried out is calculated for the respective injector. This takes place in accordance with the equation (1) above:

$$Ti_eff_N=Ti_N+Tclose_N \quad (11)$$

Step 560:

In the step 560, the deviation $\Delta Ti_N$ is calculated. The following applies here:

$$\Delta Ti_N=Ti_eff_sp_N-Ti_eff_N \quad (12)$$

Step 562:

In the step 562, a new adaptation value $f_{Adaptation}(\bullet)_N$ is calculated for a subsequent injection process. The new adaptation value $f_{Adaptation}(\bullet)_N$ is obtained recursively from the following equation (13):

$$F_{Adaptation}(\bullet)_N=c\cdot\Delta Ti_N+f_{Adaptation}(\bullet)_{N-1} \quad (13)$$

The following applies here:

$f_{Adaptation}(\bullet)_N=f_{Adaptation}$ (MFF_SP, FUP, $P_{Cyl}$, $\theta_{Fuel}$, $X_{Inj})_N$ and $f_{Adaptation}(\bullet)_{N-1}=f_{Adaptation}$ (MFF_SP, FUP, $P_{cyl}$, $\theta_{Fuel}$, $X_{Inj})_{N-1}$ This means that the adaptation value $f_{Adaptation}$ is learnt as a function of the operating conditions.

The weighting factor c can depend on the respective operating conditions by means of a characteristic diagram. The dependence on c may be determined offline on the basis of experimental investigations. This means that the following applies:

$$c=f_3(MFF_SP,FUP,P_{Cyl},\theta_{Fuel}) \quad (14)$$

It is noted that a direct, time-discrete control cannot be carried out since the control error $\Delta Ti_N$ which is determined is valid only for the operating conditions which occur during this injection pulse. For this reason, adaptation is necessary as a function of the operating conditions.

Step 564:

In the step 564, the index N is changed to the new current index N+1. The method is carried on with the step 552 described above.

In order to be able to execute each injection pulse with a very high accuracy of quantities from the start onwards for every engine start, the adaptation characteristic diagram $f_{Adaptation}$ (MFF_SP, FUP, $P_{Cyl}$, $\theta_{Fuel}$, $X_{Inj}$) can be stored for each injector in a cylinder-specific basis during the running on of the engine controller in the nonvolatile memory of the engine controller.

It is to be noted that for operation with multiple injection it is necessary for the adaptation $f_{Adaptation}$ to be carried out not only individually for each injector but also individually for each injection pulse.

LIST OF REFERENCE NUMBERS

400 coil current [A]
410 voltage signal [10 V]
420 time derivative of voltage signal [V/ms]
421 local minimum/closing time
422 further local minimum/further closing time
430 through-flow fuel [g/s]
435 reference voltage signal [10 V]
440 difference voltage signal [V]
441 maximum of the difference voltage signal
552 first step
554 second step
556 third step
558 fourth step
560 fifth step
562 sixth step
564 seventh step

What is claimed is:

1. A method for determining a duration for electric actuation of a valve comprising a coil drive, in particular of a direct injection valve for an internal combustion engine, the method comprising:

deactivating a current flow through a coil of the coil drive such that the coil is rendered currentless, detecting a time profile of a voltage induced in the currentless coil, calculating a time derivative of the detected voltage profile induced in the currentless coil, calculating or accessing a time derivative of a reference voltage profile, calculating a difference between the time derivative of the detected voltage profile and the time derivative of the reference voltage profile, determining a closing time of the valve based on the calculated difference between the time derivative of the detected time profile and the time derivative of the reference voltage profile, and determining a duration of an electric actuation of the valve for a future injection process based on the determined closing time.

2. The method of claim 1, wherein the reference voltage profile is determined by securing a magnet armature of the coil drive in a closed position of the valve and detecting a voltage induced in the currentless coil after the valve has been actuated electrically.

3. The method of claim 1, further comprising actuating the valve based on the determined duration.

4. The method of claim 3, wherein the duration of the electric actuation of the valve is carried out using an iterative procedure for a sequence of different injection pulses, in which procedure a correction value is determined for the duration of the electric actuation of the valve for a future injection process as a function of:

(a) a correction value for the duration of the electric actuation of the valve for a preceding injection process, and (b) a time difference between (b1) a nominal effective duration for the electric actuation of the valve, and (b2) an individual effective duration for the electric actuation of the valve for the preceding injection process, wherein the individual effective duration results from the time difference between the start of the electric actuation of the valve for the preceding injection process and the determined closing time for the preceding injection process.

5. The method of claim 4, wherein the time difference between the nominal effective duration and the individual effective duration is weighted with a weighting factor.

6. A device for determining a duration of electric actuation of a valve comprising a coil drive, in particular of a direct injection valve for an internal combustion engine, the device comprising:

a deactivation unit configured to deactivate a current flow through a coil of the coil drive, such that the coil is rendered currentless, a detection unit configured to detect a time profile of a voltage induced in the currentless coil, and an evaluation unit configured to:

calculate a time derivative of the detected voltage profile induced in the currentless coil, calculate or access a time derivative of a reference voltage profile, calculate a difference between the time derivative of the detected voltage profile and the time derivative of the reference voltage profile, determine the closing time of the valve based on the calculated difference between the time derivative of the detected time profile and the time derivative of the reference voltage profile, and determine a duration of an electric actuation of the valve for a future injection process based on the determined closing time.

7. The device of claim 6, wherein the reference voltage profile is determined by securing a magnet armature of the coil drive in a closed position of the valve and detecting a voltage induced in the currentless coil after the valve has been actuated electrically.

8. The device of claim 6, further configured to actuate the valve based on the determined duration.

9. The device of claim 8, wherein the duration of the electric actuation of the valve is carried out using an iterative procedure for a sequence of different injection pulses, in which procedure a correction value is determined for the duration of the electric actuation of the valve for a future injection process as a function of:

(a) a correction value for the duration of the electric actuation of the valve for a preceding injection process, and (b) a time difference between (b1) a nominal effective duration for the electric actuation of the valve, and (b2) an individual effective duration for the electric actuation of the valve for the preceding injection process, wherein the individual effective duration results from the time difference between the start of the electric actuation of the valve for the preceding injection process and the determined closing time for the preceding injection process.

10. The device of claim 9, wherein the time difference between the nominal effective duration and the individual effective duration is weighted with a weighting factor.

11. A computer program for determining a duration of electric actuation of a valve comprising a direct injection valve for an internal combustion engine, the computer program being embodiment in non-transitory computer readable media and executable by a processor to:

deactivate a current flow through a coil of the coil drive such that the coil is rendered currentless, detect a time profile of a voltage induced in the currentless coil, calculate a time derivative of the detected voltage profile induced in the currentless coil, calculate or access a time derivative of a reference voltage profile, calculate a difference between the time derivative of the detected voltage profile and the time derivative of the reference voltage profile, determine a closing time of the valve based on the calculated difference between the time derivative of the detected time profile and the time derivative of the reference voltage profile, and determine a duration of an electric actuation of the valve for a future injection process based on the determined closing time.

12. A method for determining a duration for electric actuation of a valve comprising a coil drive, in particular of a direct injection valve for an internal combustion engine, the method comprising:

deactivating a current flow through a coil of the coil drive such that the coil is rendered currentless, detecting a time profile of a voltage induced in the currentless coil, determining a closing time of the valve based on the detected time profile, determining a duration of an electric actuation of the valve for a future injection process based on the determined closing time, actuating the valve based on the determined duration of the electric actuation of the valve, wherein the duration of the electric actuation of the valve is performed using an iterative procedure for a sequence of different injection pulses, in which procedure a correction value is determined for the duration of the electric actuation of the valve for a future injection process as a function of:

(a) a correction value for the duration of the electric actuation of the valve for a preceding injection process, and (b) a time difference between (b1) a nominal effective duration for the electric actuation of the valve, and (b2) an individual effective duration for the electric actuation of the valve for the preceding injection process, wherein the individual effective duration results from the time difference between the start of the electric actuation of the valve for the preceding injection process and the determined closing time for the preceding injection process.

* * * * *